US011144008B2

(12) United States Patent
Ito et al.

(10) Patent No.: US 11,144,008 B2
(45) Date of Patent: Oct. 12, 2021

(54) IMAGE HEATING APPARATUS HAVING FIRST AND SECOND COOLING FANS COOLING AN END PORTION OF A FIRST ROTATABLE MEMBER

(71) Applicant: CANON KABUSHIKI KAISHA, Tokyo (JP)

(72) Inventors: Hiroto Ito, Tokyo (JP); Ikuo Nakamoto, Matsudo (JP); Toru Katsumi, Toride (JP); Masayuki Tamaki, Kashiwa (JP); Akiyoshi Shinagawa, Kasukabe (JP); Koichi Kakubari, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/704,757

(22) Filed: Dec. 5, 2019

(65) Prior Publication Data

US 2020/0110359 A1 Apr. 9, 2020

Related U.S. Application Data

(63) Continuation of application No. PCT/JP2018/022494, filed on Jun. 6, 2018.

(30) Foreign Application Priority Data

Jun. 6, 2017 (JP) ..... JP2017-111583

(51) Int. Cl.
*G03G 21/20* (2006.01)
*G03G 15/20* (2006.01)

(52) U.S. Cl.
CPC ..... *G03G 21/206* (2013.01); *G03G 15/2021* (2013.01)

(58) Field of Classification Search
CPC ..... G03G 15/2042; G03G 15/2017; G03G 21/206; G03G 15/2039; G03G 2221/1645
See application file for complete search history.

(56) References Cited

U.S. PATENT DOCUMENTS 5,550,621 A * 8/1996 Ogawahara ..... G03G 15/2042 399/69
7,596,348 B2 9/2009 Nakamoto et al.
(Continued)

FOREIGN PATENT DOCUMENTS

JP H05-107983 A 4/1993
JP 2006-171237 A 6/2006
(Continued)

OTHER PUBLICATIONS

International Search Report issued in corresponding parent International Application No. PCT/JP2018/022494 dated Jul. 17, 2018.
(Continued)

*Primary Examiner* — Walter L Lindsay, Jr.
*Assistant Examiner* — Jessica L Eley
(74) *Attorney, Agent, or Firm* — Venable LLP

(57) ABSTRACT

An image heating apparatus including first and second rotatable members, first and second cooling fans, an air blowing port, a shutter member, a shutter controller, and a fan controller. The first cooling fan is provided at a position opposing a first region which is a part of an end portion region of the first rotatable member on one end side. The second cooling fan is provided at a position opposing a second region which is part of the end portion region. The second region is adjacent to the first region with respect to the longitudinal direction. The shutter controller is configured to control a position of the shutter member depending on a width size of a recording material. The fan controller is configured to independently control an operation of the first
(Continued)

cooling fan and an operation of the second cooling fan depending on the width size of the recording material.

11 Claims, 8 Drawing Sheets

(56) References Cited

U.S. PATENT DOCUMENTS

| | | | |
|---|---|---|---|
| 8,554,097 | B2 | 10/2013 | Hara et al. |
| 8,917,999 | B2 | 12/2014 | Takada et al. |
| 8,929,762 | B2 | 1/2015 | Shinagawa et al. |
| 9,354,570 | B2 | 5/2016 | Arimoto et al. |
| 9,504,096 | B2 | 11/2016 | Kakubari et al. |
| 9,519,250 | B2 | 12/2016 | Asaka et al. |
| 10,303,093 | B2 | 5/2019 | Tamaki et al. |
| 10,437,185 | B2 | 10/2019 | Yamaguchi et al. |
| 10,545,442 | B1 | 1/2020 | Hirano et al. |
| 2006/0127119 | A1 | 6/2006 | Sato |
| 2009/0245839 | A1 | 10/2009 | Cook et al. |
| 2012/0308256 | A1 | 12/2012 | Suzuki |
| 2013/0034361 | A1 | 2/2013 | Shinagawa |
| 2013/0034362 | A1 | 2/2013 | Matsuura et al. |
| 2013/0236202 | A1* | 9/2013 | Akiya ..... G03G 15/2017 399/69 |
| 2013/0299480 | A1 | 11/2013 | Kakubari et al. |
| 2013/0322897 | A1 | 12/2013 | Yago et al. |
| 2014/0105658 | A1 | 4/2014 | Tamaki |
| 2014/0112680 | A1 | 4/2014 | Ueno et al. |
| 2014/0286665 | A1* | 9/2014 | Minagawa ..... G03G 15/2042 399/69 |
| 2014/0321873 | A1 | 10/2014 | Kadowaki et al. |
| 2019/0377287 | A1 | 12/2019 | Hasegawa et al. |

FOREIGN PATENT DOCUMENTS

| | | | |
|---|---|---|---|
| JP | 2012-252194 | A | 12/2012 |
| JP | 2014-102486 | A | 6/2014 |
| JP | 2014-145895 | A | 8/2014 |
| JP | 2014-224990 | A | 12/2014 |
| JP | 2016-114644 | A | 6/2016 |
| JP | 2016-114655 | A | 6/2016 |

OTHER PUBLICATIONS

Written Opinion issued in corresponding parent International Application No. PCT/JP2018/022494 dated Jul. 17, 2018.

* cited by examiner

IMAGE HEATING APPARATUS HAVING FIRST AND SECOND COOLING FANS COOLING AN END PORTION OF A FIRST ROTATABLE MEMBER

CROSS-REFERENCE TO RELATED APPLICATIONS

This application is a continuation of International Patent Application No. PCT/JP2018/022494 filed Jun. 6, 2018, which claims the benefit of Japanese Patent Application No. 2017-111583 filed Jun. 6, 2017. The foregoing applications are incorporated herein by reference in their entireties.

TECHNICAL FIELD

The present invention relates to an image heating apparatus mounted in an image forming apparatus such as a copying machine, a printer or a facsimile machine.

BACKGROUND ART

In a fixing device, when small size recording materials are subjected to continuous printing with the same print interval as large size recording materials, it is known that in a fixing member, a region constituting a non-sheet-passing portion during sheet passing of the small size recording material is excessively increased in temperature (non-sheet-passing portion temperature rise), and in general, a temperature in a non-sheet-passing region in the neighborhood of a sheet passing region end portion is highest. When the non-sheet-passing portion temperature rise occurs, heater failure such as heater crock is caused. Further, in a state in which the non-sheet-passing portion temperature rise occurs, when large size recording materials are subjected to printing, on the recording material, toner excessively melts at a portion corresponding to the non-sheet-passing region of the small size recording material, so that high-temperature offset occurs.

For this reason, it has been known that the non-sheet-passing portion is subjected to air blowing cooling using fans so as to suppress the non-sheet-passing portion temperature rise. Further, in a fixing device provided for various sheet sizes, when sheets with a narrow paper (sheet) width are passed through the fixing device, the non-sheet-passing potion region becomes a wide range, and therefore, a constitution in which a non-sheet-passing portion temperature rise portion is cooled using a plurality of fans at one side end portion of the fixing member with respect to a longitudinal direction of the fixing member has been proposed. In such a case, depending on a sheet size, control of changing ON/OFF of each of the fans is carried out. Particularly, in the case where sheets small in sheet size are passed through the fixing device, all the plurality of fans are turned on (ON), so that the non-sheet-passing portion is cooled, and a total airflow rate of these fans is large compared with the case where sheets with a broad sheet width are passed through the fixing device.

On the other hand, from viewpoints of temperature rise in the fixing device and a reduction in UFP (Ultra Fine Particles), there is a need to lower the total airflow rate of the fans. In that case, a cooling performance of the fans lowers, and therefore, due to the non-sheet-passing portion temperature rise, there was a problem such that a temperature of the fixing member in the neighborhood of the sheet passing portion end portion has become large.

Japanese Laid-Open Patent Application (JP-A) Hei 5-107983 and JP-A 2016-114655 propose a method of suppressing such non-sheet-passing portion temperature rise. In JP-A Hei 5-107983, a constitution of a fixing device in which a shutter is not provided and four fans are provided on one end side of a fixing member with respect to a longitudinal direction is disclosed. Each of the four fans is drivable (capable of on and off) in correspondence with a sheet size. Further, in JP-A Hei 5-107983, the amount of air blown by the fans is controlled correspondingly to a kind of sheets (plain paper, tracing paper, a film member). In JP-A 2016-114655, a single fan is provided on one end side with respect to a longitudinal direction, a selected shutter is rotationally moved from a sheet passing region side toward a non-sheet-passing side, and air is obliquely guided, so that directivity of air is improved and cooling is made.

Problem to be Solved by the Invention

However, in JP-A Hei 5-107983, a cooling range of the fixing member by the fans can be controlled only by turning the fans on or off, and therefore, the number of different sheet sizes that the fixing member can counter the non-sheet-passing portion temperature rise is restricted to the number of the fans. Further, in JP-A 2016-114644, one end side with respect to the longitudinal direction is cooled by the single fan, and therefore, a range of the sheet size over which the fixing member can counter the non-sheet-passing portion temperature rise is restricted to a range capable of being cooled by the single fan. Therefore, an object of the present invention is to suppress temperature rise of a rotatable member in a non-sheet-passing portion for various width size recording materials.

Means for Solving the Problem

In one aspect, an image heating apparatus according to the present invention includes first and second rotatable members for forming a nip for heating a toner image on a recording material while feeding the recording material. The image heating apparatus also includes, first and second cooling fans, an air blowing port, a shutter member, a shutter controller, and a fan controller. The first and second cooling fans cooling an end portion region of the first rotatable member on one end side. The first cooling fan is provided at a position opposing a first region the is a part of the end portion region, and the second cooling fan is provided at a position opposing a second region that is a region being a part of the end portion region. The second region is adjacent to the first region with respect to the longitudinal direction and is closer to an end portion of the first rotatable member on the one end side than the first region. The air blowing port sends air from the first and second cooling fans toward the first rotatable member. The shutter member is capable of changing an opening width of the air blowing port. The shutter controller controls a position of the shutter member depending on a width size of the recording material heated in the nip. The fan controller independently controls an operation of the first cooling fan and an operation of the second cooling fan depending on the width size of the recording material heated in the nip, in a state in which the shutter member is positioned by the shutter controller at a position depending on the width size of the recording material heated in the nip.

BRIEF DESCRIPTION OF THE DRAWINGS

FIG. 3 is a view for illustrating a structure of a heater including a heat generating element for heating a nip (portion) according to this embodiment.

EMBODIMENTS FOR CARRYING OUT THE INVENTION

In the following, embodiments of the present invention will be described on the basis of the attached drawings.

First Embodiment (Image Forming Apparatus)

Figure 10:
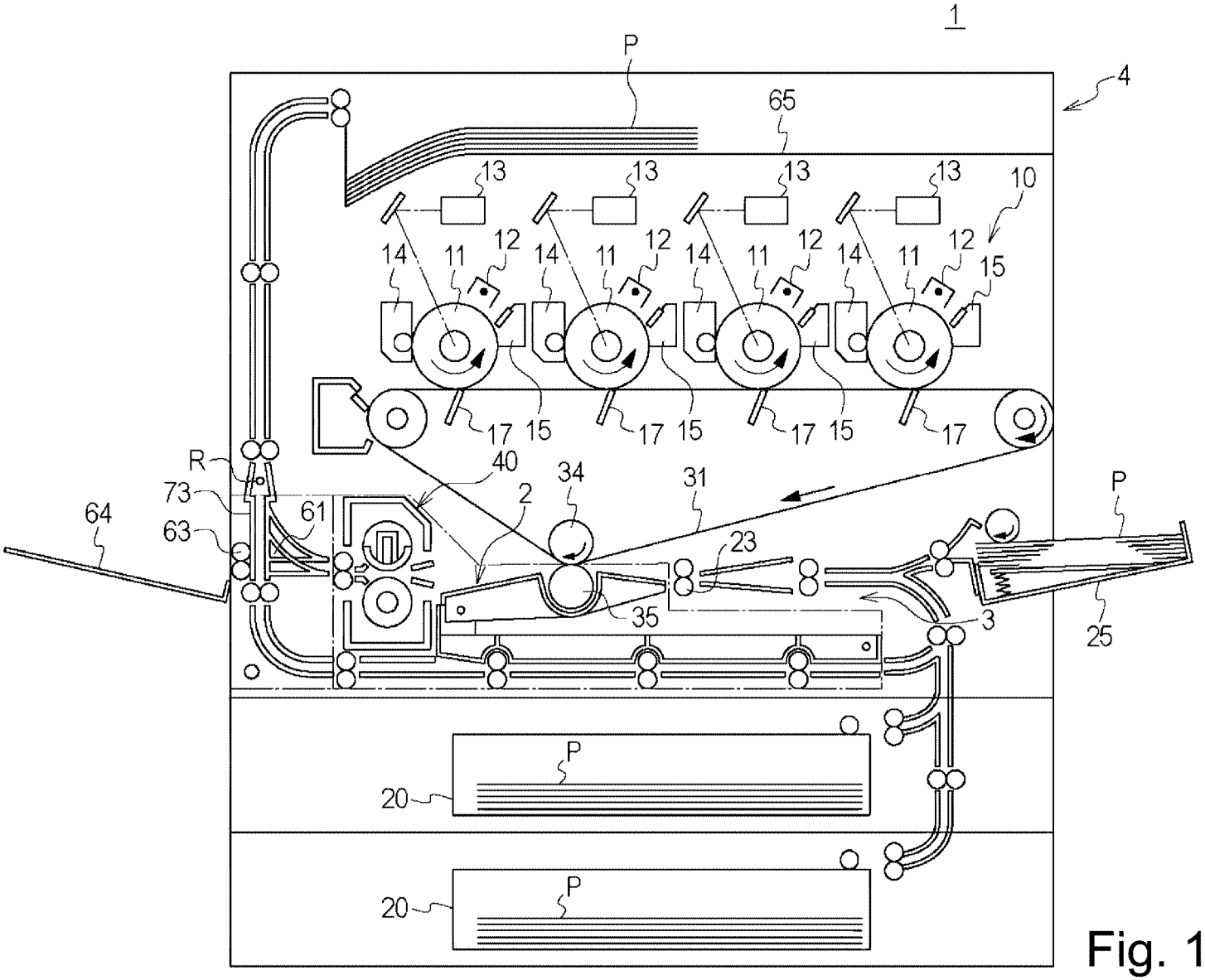
FIG. 10 is a sectional view of the image forming apparatus in which the fixing device according to this embodiment is mounted.

FIG. 10 is a sectional view of a color electrophotographic printer which is an example of an image forming apparatus in which a fixing device according to an embodiment of the present invention is mounted, and is the sectional view taken along a sheet feeding direction. In this embodiment, the color electrophotographic printer will be simply referred to as a "printer".

The printer shown in FIG. 10 includes image forming portions 10 for respective colors of Y (yellow), M (magenta), C (cyan) and Bk (black). A photosensitive drum 11 is electrically charged in advance by a charger 12. Thereafter, on the photosensitive drum 11, a latent image is formed by a laser scanner 13. The latent image is changed to a toner image by a developing device 14. Toner images on the photosensitive drums 11 are successively transferred onto, for example, an intermediary transfer belt 31 which is an image bearing member by primary transfer blades 17. After transfer, the toner remaining on each photosensitive drum 11 is removed by a cleaner 15. As a result of this, a surface of the photosensitive drum 11 becomes clean, and prepares for subsequent image formation.

On the other hand, a sheet P as a recording material (recording paper) is sent one by one from a sheet (paper) cassette 20 or a multi-sheet (paper) feeding tray 25 and is sent to a registration roller pair 23. The registration roller pair 23 once receives the sheet P and rectifies the sheet P so as to be straight in the case where the sheet P obliquely moves. Then, the registration roller pair 23 synchronizes the sheet P with the toner images on the intermediary transfer belt 31 and sends the sheet to between the intermediary transfer belt 31 and a secondary transfer roller 35.

A color toner image on the intermediary transfer belt is transferred onto the sheet P by, for example, the secondary transfer roller 35 which is a transfer(-receiving) member. Thereafter, the toner image on the sheet is fixed on the sheet by heating and pressing the sheet by a fixing device 40.

(Fixing Device)

Figure 1:
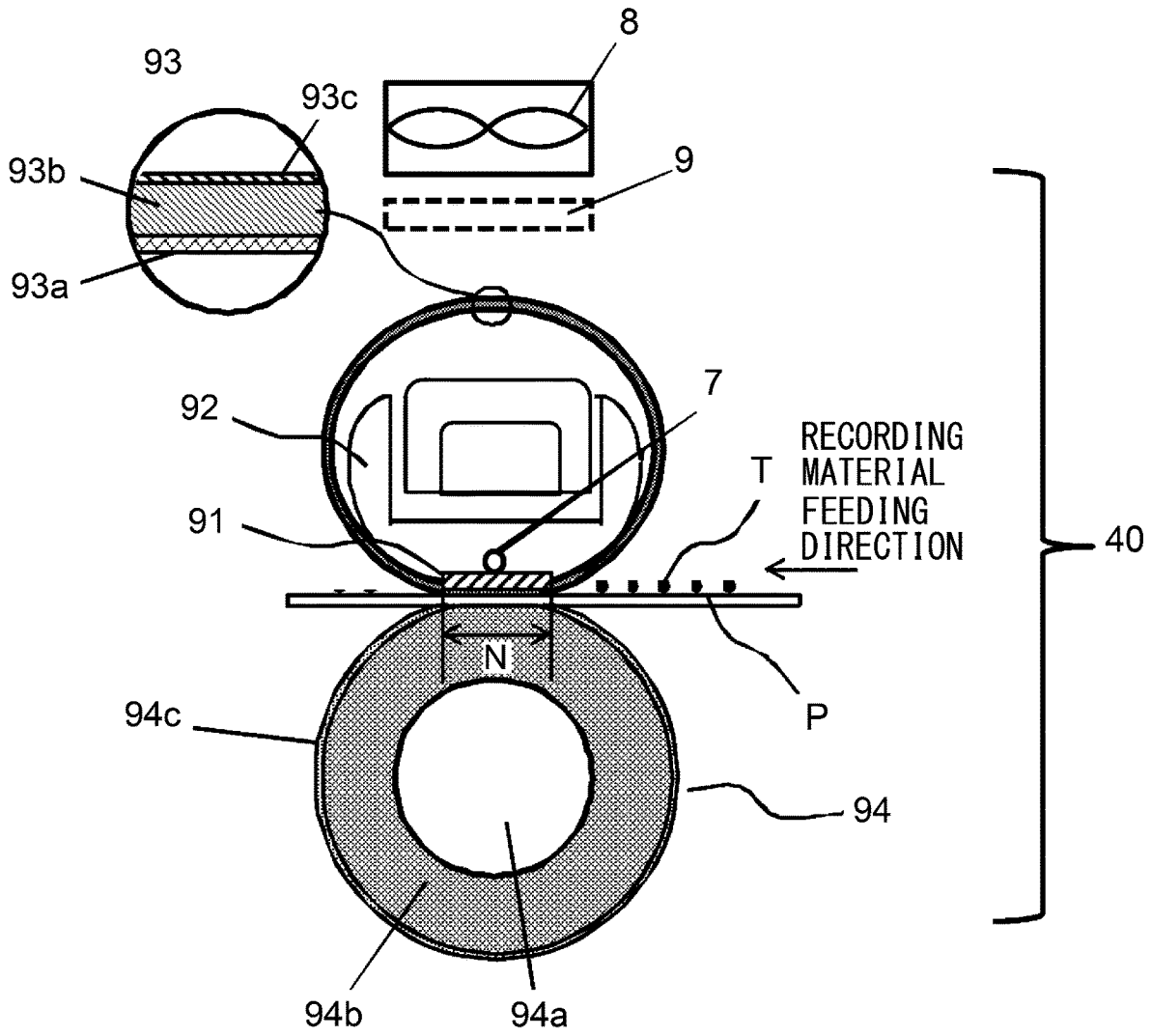
FIG. 1 is a schematic view showing an example of a structure of a fixing device according to this embodiment and a layer structure of a fixing member.

A sectional view showing an embodiment of the fixing device (image heating apparatus) 40 according to an embodiment of the present invention is shown in FIG. 1. In this embodiment, a pressing member is provided as a pressing roller 94. In the following description, with respect to the fixing device and members constituting this fixing device, a longitudinal direction is a direction perpendicular to a recording material feeding direction in a plane (surface) of the recording material. Further, a widthwise (short side) direction is a direction parallel to the recording material feeding direction in the plane of the recording material. Further, a length is a dimension with respect to the longitudinal direction. Further, a width is a dimension with respect to the widthwise direction. Further, with respect to the recording material, a width direction is the direction perpendicular to the recording material feeding direction, and a width is a dimension with respect to the width direction.

The fixing device 40 includes a ceramic heater (hereinafter, referred to as a heater) 91 as a heat generating element (heating member) and a heater holder 92 as a supporting member. Further, the fixing device 40 includes an endless fixing film 93 as a first rotatable member (rotatable heating member) and a pressing roller 94 as a second rotatable member for forming a nip (fixing nip) for heat-fixing the recording material carrying the image by nip-feeding the recording material in cooperation with the first rotatable member. The fixing film 93 as the first rotatable member is provided on a side where the fixing film 93 contacts the surface of the recording material carrying an unfixed toner image when the recording material is fixed in the nip.

The heater holder 92 is formed in a substantially trough shape in cross section by a heat-resistant material having rigidity. Further, the heater holder 92 supports the heater 91 in a groove provided on a lower surface of the heater holder 92 at a central portion with respect to the widthwise direction. The fixing film 93 is externally engaged loosely with an outer periphery of the heater holder 92 by which the heater 91 is supported. Further, onto an inner peripheral surface (inner surface) of the fixing film 93, grease is applied in order to improve a sliding property with the heater 91.

Incidentally, in FIG. 1, a fan 8 and a shutter 9 are shown, but these will be specifically described later.

(Fixing Film)

The fixing film 93 will be further described. The fixing film 93 is a rotatable endless belt member (endless belt) having a multi-layer structure in which a base layer 93*a*, an elastic layer 93*b*, and a parting layer 93*c* are provided from an inside, as shown in a fixing film layer structural view in FIG. 1. The base layer 93*a* is a thin endless belt having flexibility.

As a material of the base layer 93*a*, a thin heat-resistant resin such as polyimide, polyamideimide or PEEK is used. Further, in order to further enhance thermal conductivity, thin metal such as SUS or NI may also be used. Further, the base layer 93*a* satisfies a quick start property by making thermal capacity small and there is a need to also satisfy certain mechanical strength, and therefore, a thickness may desirably be 5 μm or more and 100 μm or less, preferably be 8 μm or more and 20 μm or less.

At an outer periphery of the base layer 93*a*, the elastic layer 93*b* formed of a silicone rubber or the like is formed. By providing the elastic layer 93*b*, it becomes possible to obtain a good image with high glossiness and with no improper fixing. That is, the parting layer 93*c* deforms against shapes of toner T on the recording material P and paper fibers of the recording material P in the fixing nip N and wraps the unfixed toner image, whereby heat can be uniformly applied to the toner image.

When the thickness of the elastic layer 93*b* is excessively thin, elasticity cannot be sufficiently achieved, and therefore, an image with high glossiness and without fixing errors cannot be obtained. When the thickness of the elastic layer 93*b* is excessively thick, the thermal capacity of the fixing film 93 becomes large, so that the quick start property lowers. For that reason, the thickness of the elastic layer 93*b* may desirably be 30 μm or more and 500 μm or less, preferably 100 μm or more and 300 μm or less.

The silicone rubber forming the elastic layer 93*b* in this embodiment is a polymer having flowability at room temperature and curing thereof progresses by heating, and is a liquid silicone rubber which has proper low hardness after the curing and which has a sufficient heat-resistant property and a deformation restoring force for use in a heating and pressing fixing device. Particularly, for the reasons such that a processing property is good and stability of dimension accuracy is high and that a reaction by-product does not generate during curing reaction, a liquid silicone rubber of an addition reaction crosslinking type may more preferably be used.

The liquid silicone rubber of the addition reaction crosslinking type is, for example, a composition which contains organopolysiloxane (liquid A) and organohydrogenpolysiloxane (liquid B) and which further appropriately contains a catalyst and another additive. The organopolysiloxane is a base polymer comprising a silicone rubber as a raw material, and a molecular weight thereof may preferably be 5,000 or more and 100,000 or less in terms of a number-average molecular weight in order that various fillers are mixed and stirred and that flowability of a resultant mixture is made in a proper range. Further, the molecular weight may more preferably be 10,000 or more and 500,000 or less in terms of a weight-average molecular weight.

As the elastic layer 93*b*, thermal conductivity is low in the silicone rubber alone. When the thermal conductivity is low, it becomes difficult to effectively conduct the heat from the heater 91 to the recording material P, so that there is a possibility that an image defect such as fixing non-uniformity due to insufficient heating occurs. For that reason, in this embodiment, in order to increase the thermal conductivity of the elastic layer 93*b*, a high thermal conductive filler is mixed and dispersed in the elastic layer 93*b*.

As the high thermal conductive filler, SIC, ZNO, AL2SO3, ALN, MGO, carbon (black) and the like are used. Further, these fillers may be used singly or as a mixture of two or more species. By mixing these fillers in the elastic layer 93*b*, it is also possible to impart electroconductivity to the elastic layer 93*b*.

On an outer periphery of the elastic layer 93*b*, the parting layer 93*c* formed of a fluorine-containing resin (material) such as tetrafluoroethylene-perfluoroalkylvinylether copolymer resin (PFA), tetrafluoroethylene resin (PTFE) or tetrafluoroethylene-hexafluoropropylene copolymer resin (FEP) is provided. The parting layer 93*c* may desirably be 1-50 μm, preferably 8-25 μm in thickness, and may also be covered with a tube or coated with paint at a surface thereof.

(Pressing Roller)

The pressing roller 94 is disposed under the fixing film 93 in parallel to the fixing film 93. Further, the fixing film 93 is pressed toward the heater 91 by the pressing roller 94 and a pressing mechanism. By this, an outer peripheral surface (surface) of the pressing roller 94 is contacted to an outer peripheral surface (surface) of the fixing film 93 in a pressed state, and an elastic layer 94*b* is elastically deformed, whereby a fixing nip (nip) N with a predetermined width is formed between the fixing film 93 surface and the pressing roller 94 surface.

The pressing roller 94 will be further described specifically. The pressing roller 94 has a multi-layer structure including a core shaft member and a cylindrical member 94*a*, a porous rubber elastic layer 94*b* provided on an outer peripheral surface thereof, and a parting layer 94*c* provided on an outer peripheral surface of the porous rubber elastic layer 94*b*.

1) Core Shaft Member and Cylindrical Member

As a material used as the core shaft member and the cylindrical member, stainless steel including a steel material such as SUS material which is subjected to nickel plating or chromium plating at a surface thereof, phosphor bronze, aluminum, or the like is suitable. Further, and endless belt or the like may be used as a pressing belt in which a thin member-resistant resin (material) such as polyimide, polyamideimide or PEEK, or thin metal such as SUS or NI is used as a material for the cylindrical base material. An outer diameter of the core shaft member and the cylindrical member 94*a* may be 4 mm or more and 80 mm or less. In this embodiment, SUS material of 20 mm in outer diameter was used as the cylindrical base material.

2) Porous Elastic Layer and Parting Layer

The porous elastic layer 94*b* is formed of a rubber consisting of a material, such as a silicone rubber, that is soft heat-resistant. Further, the porous elastic layer 94*b* is formed on the core shaft member and the cylindrical member 94*a* in a substantially uniform thickness. A thickness of the porous elastic layer 94*b* is not particularly restricted if the thickness is such that a desired width of the nip N can be formed, but may preferably be 2.0-10.0 mm. Hardness of the porous elastic layer 94*b* may preferably be in a range of 20° or more and 70° or less from the viewpoint that the desired width of the nip N is ensured.

The parting layer 94*c* may also be formed by coating a PFA tube on the porous elastic layer 94*b* or may also be formed by coating paint consisting of a fluorine-containing resin (material) such as PFA, PTFE or FEP. The thickness of the parting layer 94*c* is not particularly restricted if the thickness is such that a sufficient parting property can be imparted, but may preferably be 15-80 μm.

Further, an end portion of the fixing film 93 with respect to the longitudinal direction is supported by a flange 6 (FIG. 5), so that a position of the fixing film 93 with respect to the longitudinal direction is regulated (restricted).

(Temperature Detecting Member)

Figure 2:
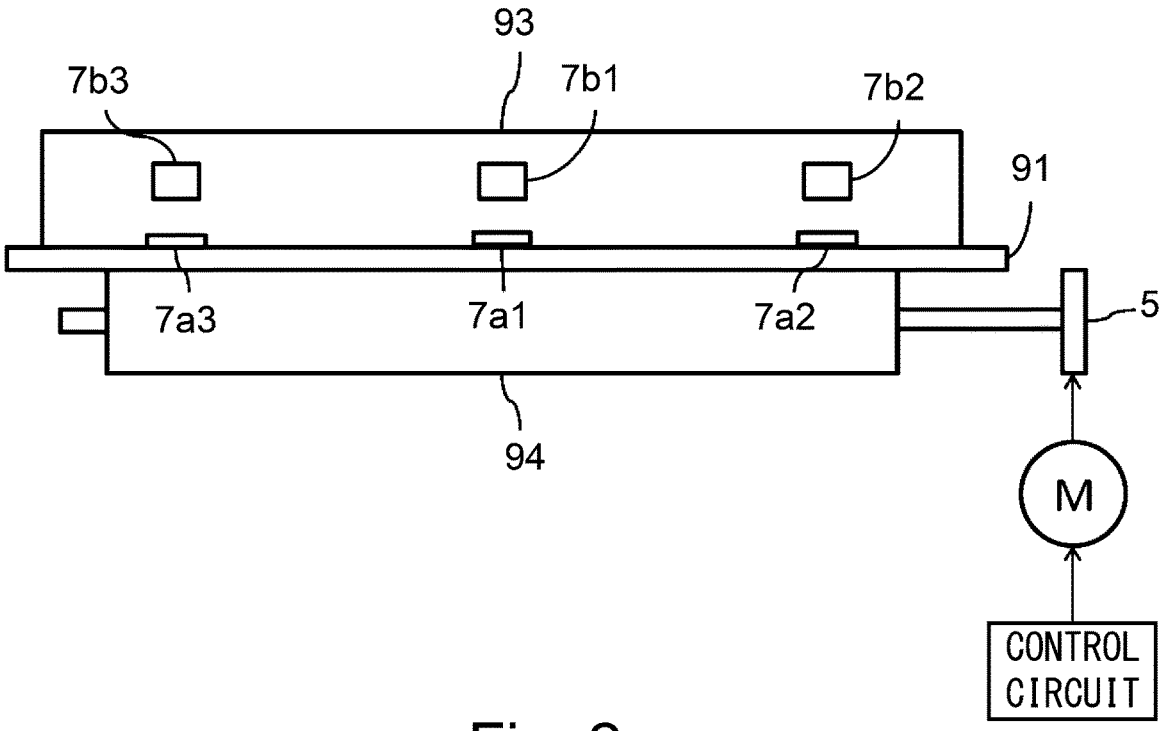
FIG. 2 illustrates an arrangement of a temperature detecting means according to this embodiment.

Next, in FIG. 1 and FIG. 2, a contact thermistor 7 as a temperature detecting member (detecting portion) will be described. FIG. 2 shows an inside of the fixing device when the fixing device is seen from a recording material feeding direction, and the fixing device of this embodiment operates a motor M as shown in FIG. 2, so that the pressing roller 94 and the fixing film 93 are rotated via a gear 5.

In FIG. 2, contact thermistors 7 including heater-back thermistors 7*a* (7*a*1, 7*a*2, 7*a*3) and film-back thermistors 7*b*

(7*b*1, 7*b*2, 7*b*3) are provided at predetermined positions with respect to the longitudinal direction. The heater-back thermistors 7*a*1, 7*a*2 and 7*a*3 are contact thermometers (thermistors) contacting a back surface of the heater 91 and measure (detect) a temperature of the heater 91. The heater-back thermistors 7*a*1, 7*a*2 and 7*a*3 are disposed at 3 positions with respect to the longitudinal direction (rotational axis direction of the pressing roller 94), and the heater-back thermistor 7*a*1 disposed at a central portion is in a longitudinal central position, and the heater-back thermistors 7*a*2 and 7*a*3 disposed at end portions are in positions of ±150 [mm] from the central position.

Further, the film-back thermistors 7*b* (7*b*1, 7*b*2, 7*b*3) are contact thermometers (thermistors) contacting a back surface (inner surface) of the fixing film 93 and measure (detect) a temperature of the fixing film 93. The film-back thermistors 7*b*1, 7*b*2 and 7*b*3 are disposed at 3 positions with respect to the longitudinal direction (rotational axis direction of the pressing roller 94), and the film-back thermistor 7*b*1 disposed at a central portion is in a longitudinal central position, and the film-back thermistors 7*b*2 and 7*b*3 disposed at end portions are in positions of ±150 [mm] from the central position.

(Heater)

Figure 3:
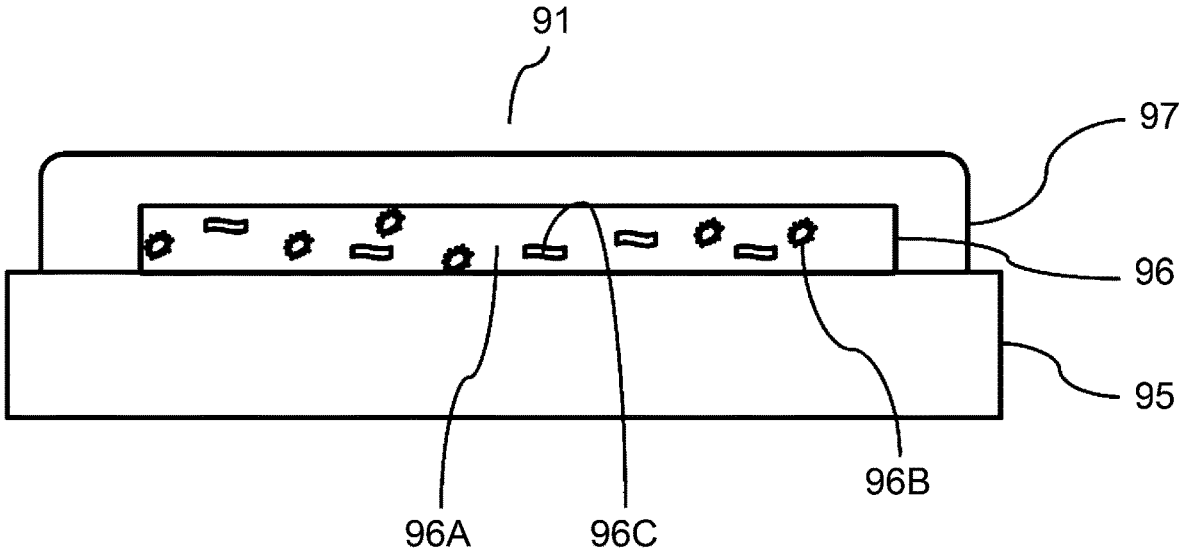
FIG. 3 illustrates a structure of a heater including a heat generating element for heating a nip (portion) according to this embodiment.

Using FIG. 3, the heater 91 for heating the fixing film 93 in contact with an inner surface of the fixing film 93 will be specifically described. The heater 91 includes a substrate 95, a heat generating element 96 formed on the substrate 95, and an insulative coating layer 97 for coating the heat generating element 96. The substrate 95 is a member for determining a dimension and a shape of the heater 91, and as a material, a ceramic material, such as alumina or aluminum nitride, excellent in heat-resistant property, heat-conductive property and electric insulation property is used. In this embodiment, as the substrate 95, alumina (plate) of 400 mm length with respect to the longitudinal direction, 8.0 mm in length with respect to the widthwise direction, and about 1 mm in thickness is used. Thermal conductivity of this heater 91 is 20 [W/m*K].

On the substrate 95, by a screen printing method, the heat generating element 96 and an electroconductor pattern for causing a current to flow from a power source to the heat generating element 96 is formed. In this embodiment, as the electroconductive pattern, silver paste or alloy paste in which silver is mixed with a small amount of palladium which are a low resistivity material is used. Further, as the heat generating element 96, paste of silver-palladium alloy is used for providing a predetermined resistance value is used, and this paste is prepared by incorporating palladium 96B, glass fiber 96C and the like in silver 96A so as to provide the desired resistance value.

The heat generating element 96 and the electroconductive pattern are coated with the insulative coating layer 97 consisting of heat-resistant glass, and are electrically protected so as not to cause leakage and short-circuit.

On an end side of the substrate 95 with respect to the longitudinal direction, an electrode electrically connected to the power source is provided (not shown). A total resistance of the heat-generating element 96 is about 10Ω, so that at an applied voltage of 100 V, it is possible to output electric power up to 1000 [W].

(Controller of Image Forming Apparatus)

Figure 4:
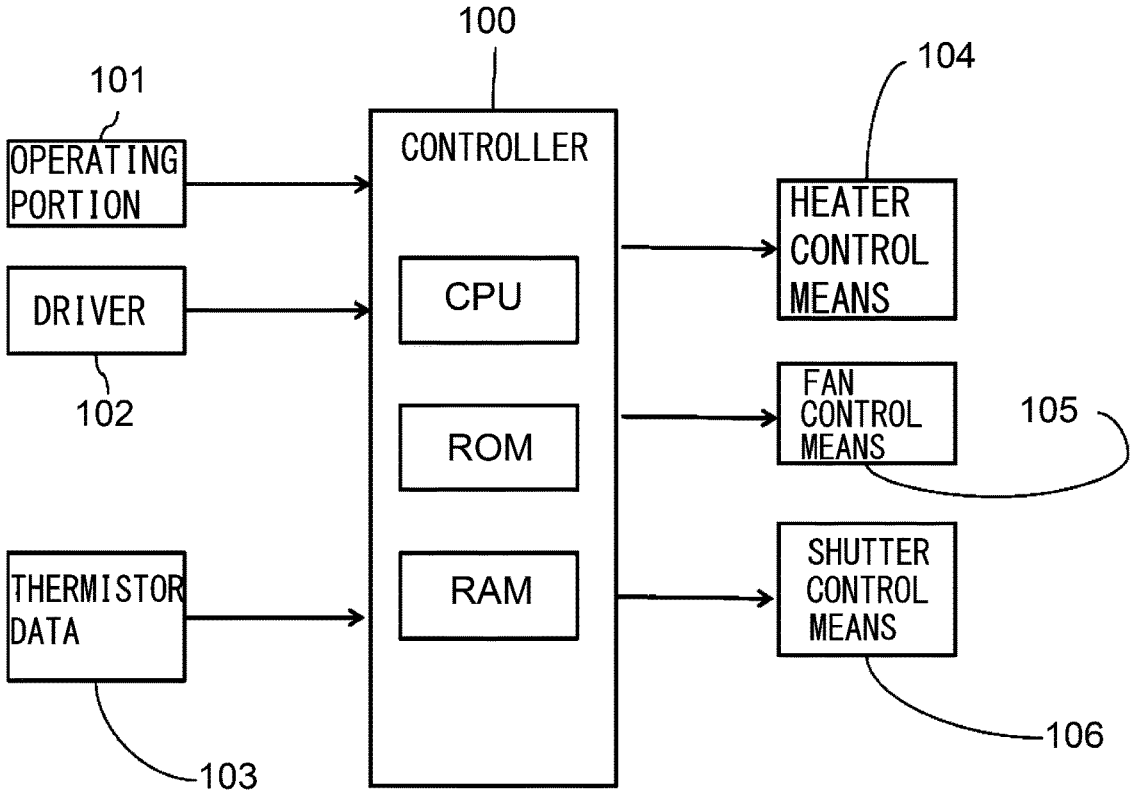
FIG. 4 is a block diagram showing a hardware constitution of an image forming apparatus in which the fixing device according to this embodiment is mounted.

In FIG. 4, a constitution of a controller (control portion) of the image forming apparatus regarding the fixing device 40 of this embodiment is shown. As the controller, a CPU (Central Processing Unit), a ROM (Read Only Memory), and a RAM (Random Access Memory) are provided.

In the ROM, an operation control program of this apparatus is stored. In the RAM, temporary calculation result and data are stored. Control of entirety of the image forming apparatus is carried out by a controller 100, and to this, an operating portion 101 constituted by a liquid crystal panel, buttons and the like, and a driver 102 for transmitting, to the controller, print job information when printing from a PC is carried out are connected. By input of various conditions from the operating portion 101 and the driver 102 by a user, the image forming apparatus starts an operation. Information on a size, a basis weight and the like of a sheet to be passed through the fixing device is sent from the operating portion 101 and the driver 102 to the controller 100.

Thermistor data 103 of the fixing device 40 are data acquired from the contact thermistors 7 (FIG. 2), and information is sent to the controller 100. The controller 100 operates a heater control means 104 and a fan control means 105 on the basis of the information from the contact thermistors 7 described above. Further, on the basis of a size of the sheet to be passed through the fixing device, a shutter means 106 described later is operated.

(End Portion Cooling Fan)

Figure 5:
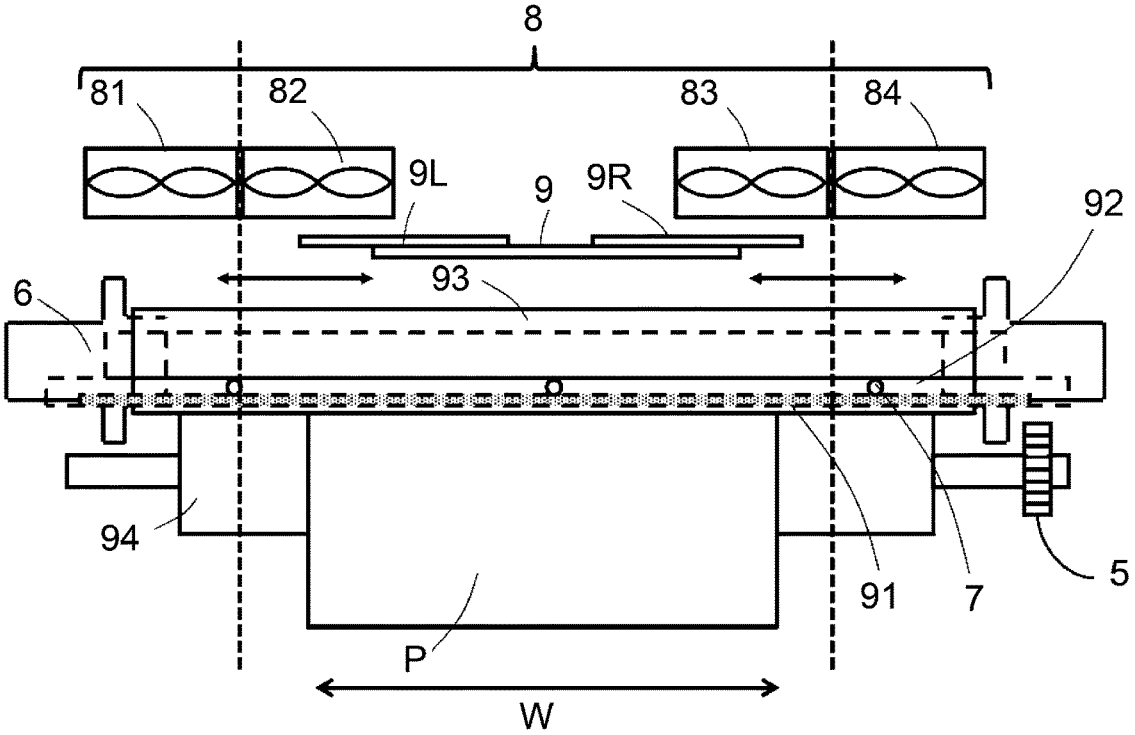
FIG. 5 is a schematic view showing the fixing device according to this embodiment and a positional relationship of fans with respect to the longitudinal direction.

In this embodiment, in order to suppress non-passing portion temperature rise with respect to non-passing portions for various sheet sizes, a plurality of fans are provided in an end portion region on one side and a shutter for changing an opening width of an air blowing part (opening) of the fans in the end portion region is provided. In this embodiment, as an example thereof, a constitution in which two cooling fans are provided on one end side of a fixing member and four cooling fans in total with respect to entirety of the longitudinal direction are provided will be described as an example. FIG. 5 is a view for illustrating a positional relationship, with respect to the longitudinal direction, of fans (cooling fans) 8 relative to the fixing film 93 as the first rotatable member of the fixing device 40. In FIG. 5, in order to cool both end sides of the fixing film 93 with respect to the longitudinal direction, the plurality of fans 8 provided on one side of the longitudinal direction (on one end side of the longitudinal direction) are disposed symmetrically so as to oppose on both end sides of the fixing film 93 with respect to the longitudinal direction. In this embodiment, the fans 8 cool end portions of the first rotatable member with respect to the longitudinal direction, but a constitution in which the fans 8 cool a region (end portion) with respect to the longitudinal direction in which the recording material does not pass through the fixing device for at least one of the first and second rotatable members for forming the nip may only be required to be employed.

In this embodiment, on one side (one end side) of the longitudinal direction, a first fan (cooling fan) and a second fan (cooling fan) provided on an end portion side with respect to the longitudinal direction than the first fan is, are provided. In FIG. 5, on both end sides of the longitudinal direction, a fan 81 (cooling fan) provided on an outside in a side which is not a gear 5 side of the pressing roller 94, a fan 82 (cooling fan) provided on an inside (in the side which is not the gear 5 side), a fan 83 (cooling fan) provided on an inside in the gear 5 side of the pressing roller 94, and a fan 84 (cooling fan) provided on an outside (in the gear 5 side) are provided.

In this embodiment, the fan 82 and the fan 83 which are positioned on the inside of the end portions, respectively, with respect to the longitudinal direction are similarly controlled and perform a similar function. Further, the fan 81 and the fan 84 which are positioned on the outside of the end portions, respectively, with respect to the longitudinal direction are similarly controlled and perform a similar function. In the following description, the fan provided at a position opposing a first region of the fixing member in an end portion region on one side with respect to the longitudinal direction (i.e., the inside fan) is referred to as the first fan in some cases. Further, the fan provided at a position opposing a second region which is adjacent to the first region in the end portion region on the same side and which is closer to the end portion of the fixing member on the same side than the first region is (i.e., the outside fan), is referred to as the second fan in some cases. That is, the fans 82 and 83 function as the first fan, and the fans 81 and 84 function as the second fan. The first fan and the second fan are arranged in contact with (adjacent to) each other with respect to the longitudinal direction as shown in FIG. 5, and are disposed at positions such that a boundary between the first fan and the second fan is ±120 [mm] from a central position (an interval between boundaries on both sides is 240 mm).

The first and second fans are disposed so that for recording materials with a first size W1 and a second size smaller than the first size, with respect to the longitudinal direction, one end side region (region where the recording materials do not pass through the fixing device) of at least one of the first and second rotatable members is subjected to airflow (blowing) cooling.

In this embodiment, the fans 8 is constituted by two fans on one side (one end side) with respect to the longitudinal direction, but the number of the fans is not restricted to two, but may also be three or more. Incidentally, as the fans 8 in this embodiment, a propeller fan was used. As the fan other than the propeller fan, it is possible to use a centrifugal fan such as a sirocco fan.

(Shutter)

As shown in FIG. 1 and FIG. 5, above the fixing film 93, a shutter 9 (shutter member) for opening and closing air blowing parts as openings of air blowing from the fans 8 is provided. The shutter 9 moves to a predetermined position with respect to the longitudinal direction on the basis of sheet size information (width direction). By this, cooling by air blowing of the fan 8 at an optimum air blowing part position depending on a sheet size can be realized.

Specifically, on the basis of a size (width direction) of the sheet to be passed through the fixing device, the controller 100 (FIG. 4) operates (controls) the shutter control means (shutter controller) 106 (FIG. 4). The shutter 9 is constituted by a shutter 9L provided on a side opposite from the gear 5 and a shutter 9R provided on the gear 5 side. Widths (opening widths) of the air blowing parts can be adjusted by moving the left and right shutters 9L and 9R. That is, the shutter 9 is capable of changing the air blowing part, and the shutter control means 106 controls the position of the shutter 9 depending on the size of the sheet on which the image is fixed. When the sheet size information is inputted in the controller 100, by a shutter motor (not shown), the left and right shutters 9L and 9R move to positions corresponding to the sheet width. In this embodiment, the width (opening width) of each air blowing part was 80 mm in the case where the sheet size is STMTR which is small.

(Fan Airflow Rate Control)

Next, airflow rate control of the fan 8 in this embodiment will be described.

As described above, in a constitution in which the plurality of fans are provided on one side of the fixing member with respect to the longitudinal direction, and further, the shutter 9 capable of changing the opening width of the air blowing part thereof to the position corresponding to the width size of the sheet is provided, a region where cooling by the fan is not needed is closed by the shutter 9. Therefore, for the recording materials with various sheet sizes, it is possible to suppress temperature rise of the fixing member at the non-sheet-passing portions.

However, unnecessary operation of the fan is not preferable since electric power consumption by the fans increases. Therefore, in order to suppress the electric power consumption by this fan, in a state in which the shutter 9 is in the position depending on the sheet size during fixing, further, operations of the first fan and the second fan are independently controlled depending on the sheet size during fixing. Incidentally, in control of the operation of the first fan and in control of the operation of the second fan, the case where the fan is turned off (is not rotated) is also included.

In this embodiment, the airflow rate control of the fan 9 is carried out by control of a voltage Duty by PWM (Pulse Width Modulation). Specifically, a maximum driving voltage of the fan 8 is 24 V, and a rotational speed at that time is 1800 rpm. The voltage Duty and the rotational speed are in a proportional relationship, and by changing the voltage Duty, the rotational speed of the fan motor is changed, so that the airflow rate (air blowing rate) of the fan 8 is changed. That is, the fan control means 105 functions as a fan controller for controlling the operations of the first fan and the second fan. The fan control means 105 controls the rotational speed of each of the fans by controlling an input voltage (specifically the voltage Duty) to each of the fans.

In this embodiment, the airflow rate is represented by a volume of gas (air) flowing per unit time ($m^3$/sec). Incidentally, as regards the above-described fans 81-84, it is possible to independently control the voltage Duty.

(Evaluation Condition)

<Non-Sheet-Passing Portion Temperature Rise Evaluation>

In evaluation of the non-sheet-passing portion temperature rise, the fixing device of the film heating type which was prepared by the above-described method and which is shown in FIG. 1 was used. Incidentally, in this embodiment, the fixing film was used as the first rotatable member, but a fixing member of a roller type may also be used as the first rotatable member.

A peripheral speed of the pressing roller 4 mounted in the fixing device of FIG. 1 was adjusted so as to be 234 mm/sec, so that temperature control was set so that the temperature of the contact thermistor 7*a*1 was 230° C. In an environment of 15° C. in temperature and 15% in humidity, paper (sheet) passed as the recording material P through the nip of the fixing device of FIG. 1 is STMTR size paper (sheet width: 140 mm) of 75 g/$m^2$ in basis weight. A temperature of a surface of the film 3 in a non-sheet-passing region (region in which the STMTR size paper did not pass through the nip N) when 500 sheets were continuously passed through the nip was measured using infrared thermography FSV-7000S manufactured by K. K. Apiste.

(Airflow Rate Control)

Figure 6:
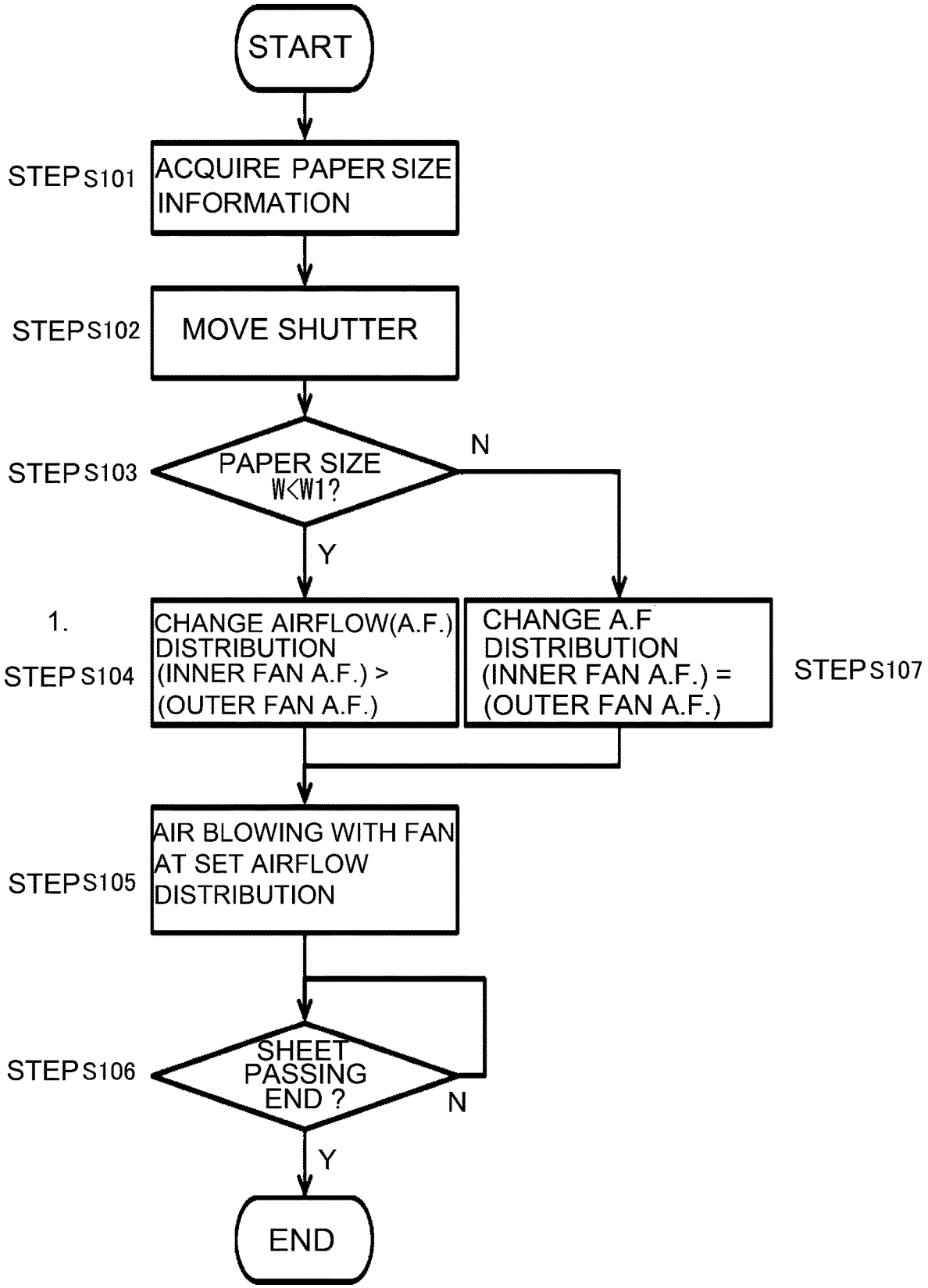
FIG. 6 is a flowchart showing control executed in a first embodiment.

The airflow rate control of the fan 8 described in the following is carried out on the basis of sheet size information (sheet width W) received from the operating portion 101 (FIG. 4) and the driver 102 (FIG. 4) at the time of a start of a printing job. FIG. 6 is a flowchart showing control executed by the controller 100.

As shown in the following flowchart, on the basis of the sheet size information (sheet width W) received from the operating portion 101 (FIG. 4) and the driver 102 (FIG. 4) at the time of the start of the printing job, the controller 100 causes the shutter 9 to be located at a position corresponding to a width size of the sheet on which the image is to be fixed.

Then, the controller 100 individually controls a fan operation depending on the width size of the sheet (on which the image is to be fixed) in the case where the controller 100 discriminated that the fan operation is needed (for example, in the case where when a plurality of sheets with a certain width size are continuously subjected to a fixing process, a temperature of the fixing member in the end portion region increased).

In the following, description will be made specifically.

The controller 100 receives the sheet width information from the driver 102 (step S101). Then, the controller 100 causes the shutter to move to a predetermined position with respect to the longitudinal direction (step S102). Then, the controller 100 discriminates whether or not a sheet width W is smaller than a predetermined width (first size) W1 (step S103). As this W1, a width narrower than an interval of 240 mm between left and right intermediary lines (left and right vertical broken lines of FIG. 5) which are boundaries each between (adjacent) fans continuously arranged at an end portion of the fixing member no one side as shown in FIG. 5 may desirably be used.

Thus, for the recording material with the first size W1, as the recording material width size, which does not exceed a boundary between the first and second fans adjacent to each other with respect to the longitudinal direction on one end side, the non-sheet-passing portion of at least one of the first and second rotatable members is cooled by the first and second fans through air blowing. Incidentally, even in the case where a position within a range of the first fan 82 and a position within a range of the first fan 83 in FIG. 5 are both ends, the first fans 82 and 83 cool the non-sheet-passing portion where the recording material does not pass, through air blowing (cool, together with the second fans, the non-sheet-passing portion through air blowing). In this embodiment, as the width size of the recording material, the first size W1=160 mm was set.

In the case where the controller 100 discriminated that the sheet width W is a second size narrower than W1 which is the first size (step S103: YES), the controller 100 carried out control in the following manner. That is, the controller 100 changes an airflow rate of the fan 82 and the fan 83 on sides close to a center so as to be larger than an airflow rate of the fan 81 and the fan 84 on sides close to end portions (step S104). Specifically, a total airflow rate of the fans on one end side with respect to the longitudinal direction is taken as 100%, and an airflow ratio (airflow rate ratio) is set so that the airflow ratio of inside (inner) fans (fan 82, fan 83) which are the first fans is 70% and the airflow ratio of outside (outer) fans (fan 81, fan 84) which are the second fans is 30%.

This control in the controller 100 corresponds to control of the first airflow rate relative to the second airflow rate by a second airflow ratio (70/30=2.33) larger than a first airflow ratio (50/50=1.00).

After the step S104, in the case where discrimination that a fan operation is needed is made by the temperature detecting member, the fan operation is carried out at the airflow ratio set in the step S104 (step S105). Then, the airflow rate control is ended at timing when all of jobs are ended (step S106).

On the other hand, in the step S103, in the case where the controller 100 discriminated that the sheet width W is not narrower than W1 (step S103: NO), the controller 100 carried out the airflow rate control in the following manner. That is, the controller 100 changes an airflow rate distribution so that an airflow rate of the fans (fan 82, fan 83) on sides close to a center and an airflow rate of the fans (fan 81, fan 84) on sides close to end portions are equal to each other (step S107). Specifically, in the case where the total airflow rate of the respective fans is taken as 100%, and the airflow ratio is set so that the airflow ratio of the inside (inner) fans (fan 82, fan 83) is 50% and the airflow ratio of the outside (outer) fans (fan 81, fan 84) is 50%.

This control in the controller 100 corresponds to control of the first airflow rate relative to the second airflow rate by the first airflow ratio (50/50=1.00) smaller than the second airflow ratio (70/30=2.33).

The airflow rates (ratios) of the fans 81 to 84 depending on the sheet size (width size of the recording material) with respect to the width direction in this embodiment described above are shown in a table 1 by taking the total airflow rate (ratio) of the fans on one end side with respect to the longitudinal direction as 100%.

TABLE 1

| Sheet size | Fan 81 | Fan 82 | Fan 83 | Fan 84 |
|---|---|---|---|---|
| W < W1 | 30% | 70% | 70% | 30% |
| W ≥ W1 | 50% | 50% | 50% | 50% |

That is, in the case where discrimination that cooling of the end portion region (non-sheet-passing portion) is needed in the case where the images are continuously fixed on the plurality of sheets of the recording materials with the sheet size smaller than the first size W1 is made, and the cooling operation is carried out, the inside fans are rotated at a speed such that the airflow rate (ratio) is 70%, and the outside fans are rotated at a speed such that the airflow rate (ratio) is 30%.

On the other hand, in the case where discrimination that the cooling of the end portion region (non-sheet-passing portion) is needed in the case where the images are continuously fixed on the plurality of sheets of the recording materials with the sheet size larger than the first size W1 is made, and the cooling operation is carried out, the inside fans are rotated at a speed such that the airflow rate (ratio) is 50%. That is, the rotational speed of the inside fans is made smaller than the rotational speed when the sheet size is the sheet size smaller than the first size W1. Further, the outside fans are rotated at a speed such that the airflow rate (ratio) is 50%. The rotational speed of the outside fans is made larger than the rotational speed when the sheet size is the sheet size smaller than the first sheet size W1.

Incidentally, in this embodiment, a constitution in which in the case where the recording material with the sheet size larger than the first size W1, the inside fans are rotated by lowering the rotational speed to the speed such that the airflow rate (ratio) thereof is 50% was employed, but the inside fans may also be turned off (stopped) depending on a magnitude of the sheet size larger than the first size W1.

(Effect)

Figure 7:
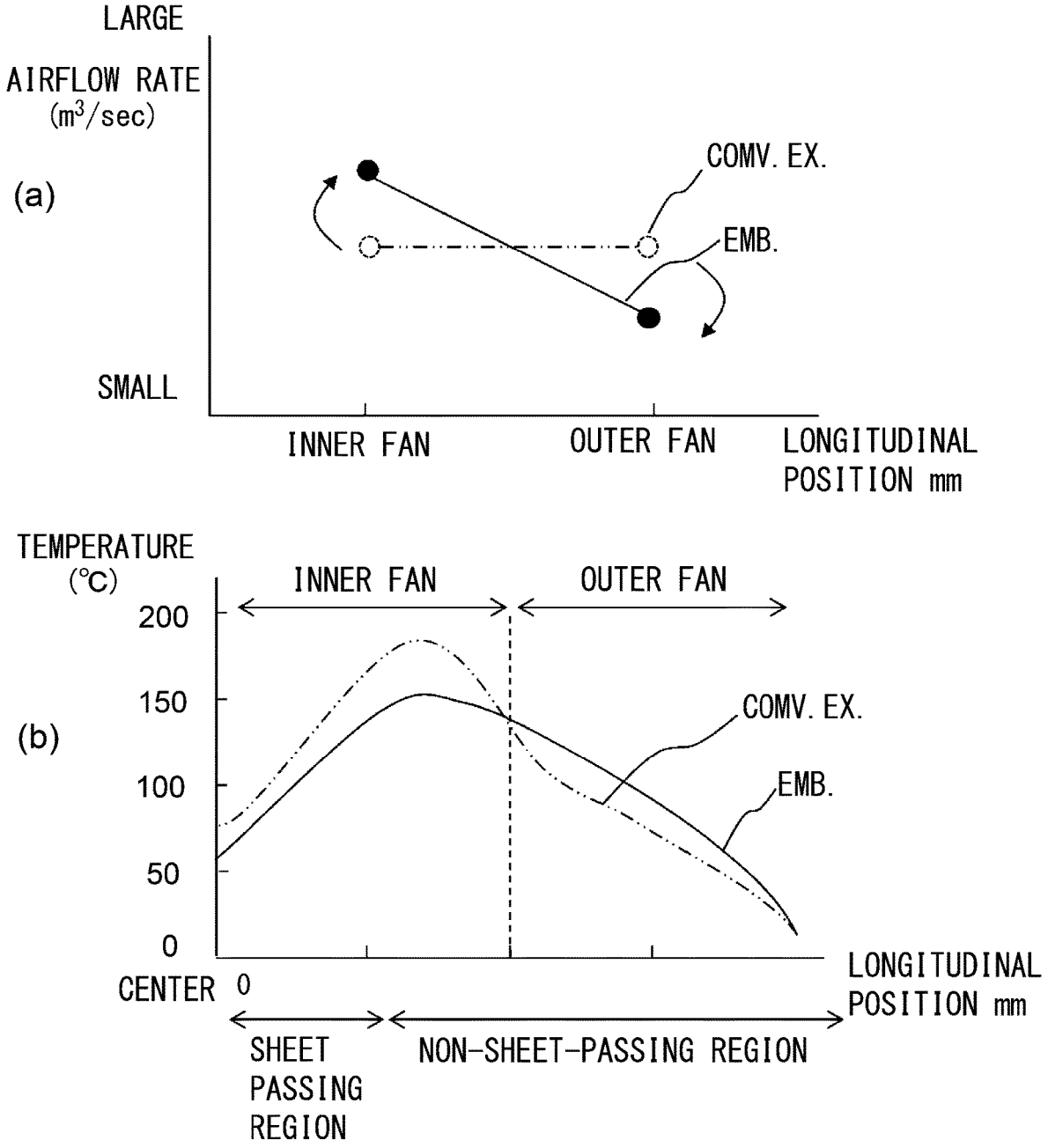
In FIG. 7, part (a) is a view for illustrating an airflow rate of each of first and second fans in this embodiment and in a conventional example, and part (b) is a view showing an effect in this embodiment.

FIG. 7 includes views showing an effect obtained by the control of this embodiment in the case where the controller 100 discriminated that the sheet width W is narrower than W1. In part (a) of FIG. 7, a white circle of a broken line shows a conventional example, and a block circle (dot) of a solid line shows this embodiment. In this embodiment, the airflow rate (ratio) of the inside fans (first fans) close to the center is larger than the airflow rate (ratio) of the outside fans (second fans). Part (b) of FIG. 7 shows a temperature distribution of a fixing member surface when the airflow rate distribution is changed as shown in part (a) of FIG. 7. It is understood that compared with the conventional example, the non-sheet-passing portion temperature rise is suppressed in this embodiment. That is, a temperature at a boundary portion between the sheet passing portion and the non-sheet-passing region lowers.

Thus, in this embodiment, without adding a particular component part, by controlling the airflow ratio of the plurality of fans 8 disposed at one side end portion of the fixing member, the non-sheet-passing portion temperature rise can be improved (suppressed) even at a small total airflow rate of the fans.

Second Embodiment

Figure 8:
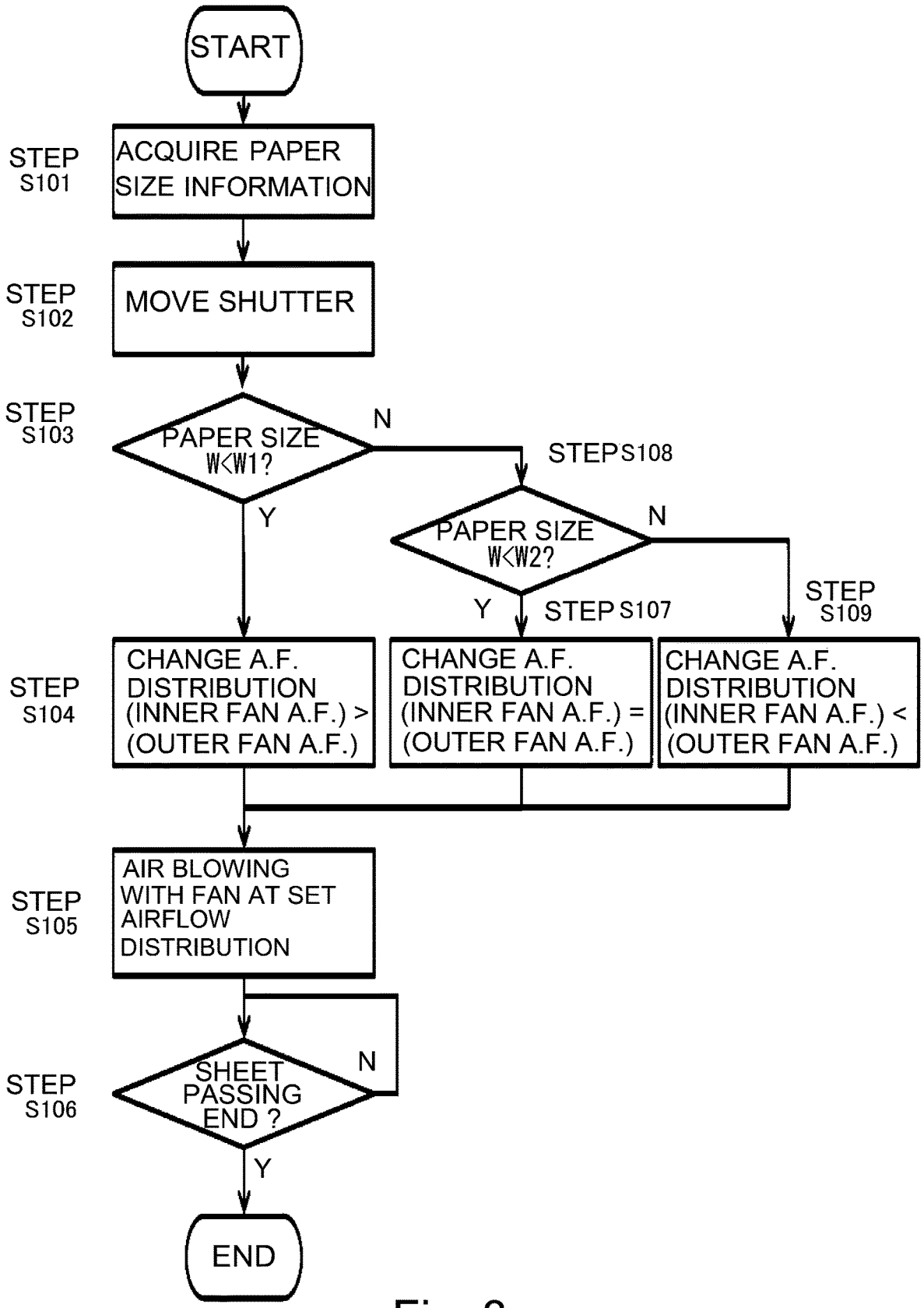
FIG. 8 is a flowchart showing control executed in a second embodiment.

In the first embodiment, as regards the sheet size (recording material size) with respect to the width direction, two classifications are made, but in this embodiment, three classifications are made. A flowchart of this embodiment is shown in FIG. 8. In FIG. 8, in addition to the flowchart (FIG. 6) of the first embodiment, in the case where the controller 100 discriminated that the sheet (paper) width is not narrower than W1 (step S103: NO), the controller 100 discriminates whether or not the sheet width is larger than a predetermined sheet (paper) width W2 (step S108). In this embodiment, W2=180 mm was set. This W2 is set at a value larger than W1 described above, but is not particularly restricted.

Similarly as in the first embodiment, in this embodiment in the case where the controller 100 discriminated that the sheet width W is a second size narrower than W1 (step S103: YES), the controller 100 carried out control in the following manner. That is, the controller 100 sets the airflow ratio so that the airflow ratio of the inside (inner) fans (fan 82, fan 83) which are the first fans is 70% and the airflow ratio of the outside (outer) fans (fan 81, fan 84) which are the second fans is 30%. This control in the controller 100 corresponds to control of the first airflow rate relative to the second airflow rate by a second airflow ratio (70/30=2.33) larger than a first airflow ratio (50/50=1.00).

Further, similarly as in the first embodiment, in this embodiment in the case where the controller 100 discriminated that the sheet width W is a second size narrower than W1 and that the sheet width is narrower than W2 (step S108: YES), the controller 100 carried out control in the following manner. That is, the controller 100 sets the airflow ratio so that the airflow ratio of the inside (inner) fans (fan 82, fan 83) is 50% and the airflow ratio of the outside (outer) fans (fan 81, fan 84) is 50%. This control in the controller 100 corresponds to control of the first airflow rate relative to the second airflow rate by the first airflow ratio (50/50=1.00).

Further, in this embodiment, in the case where the controller 100 discriminated that the sheet width is larger than W2 (step S108: NO), the controller 100 carried out the airflow rate control in the following manner. That is, the controller 100 changes the airflow rate of the fans (fan 82, fan 83) on sides close to a center so as to be smaller than the airflow rate of the fans (fan 81, fan 84) on sides close to end portions (step S109). Specifically, in the case where the total airflow rate of the respective fans is taken as 100%, and the airflow ratio is set so that the airflow ratio of the inside (inner) fans (fan 82, fan 83) which are the first fans is 30% and the airflow ratio of the outside (outer) fans (fan 81, fan 84) which are the second fans is 70%.

This control in the controller 100 corresponds to control of the first airflow rate relative to the second airflow rate by a third airflow ratio (30/70=0.43) smaller than the first airflow ratio (50/50=1.00).

The airflow rates (ratios) of the fans 81 to 84 depending on the sheet size (recording material size) with respect to the width direction in this embodiment described above are shown in a table 2 by taking the total airflow rate (ratio) of the fans on one end side with respect to the longitudinal direction as 100%.

TABLE 2

| Sheet size | Fan 81 | Fan 82 | Fan 83 | Fan 84 |
|---|---|---|---|---|
| W < W1 | 30% | 70% | 70% | 30% |
| W1 ≤ W < W2 | 50% | 50% | 50% | 50% |
| W ≥ W2 | 70% | 30% | 30% | 70% |

Incidentally, in this embodiment, a constitution in which in the case where the recording material with the sheet size larger than the second size W2, the inside fans are rotated by lowering the rotational speed to the speed such that the airflow rate (ratio) thereof is 30% was employed, but the inside fans may also be turned off (stopped) depending on a magnitude of the sheet size larger than the second size W2. Thus, even in this embodiment, without adding a particular component part, by controlling the airflow ratio of the plurality of fans 8 disposed at one side end portion of the fixing member, the non-sheet-passing portion temperature rise can be improved (suppressed) even at a small total airflow rate of the fans. Further, by adding predetermined control on the basis of the first embodiment, an efficient cooling operation which depends on the sheet size and which is high in directivity of the fan airflow rate distribution can be performed, so that the non-sheet-passing portion temperature rise can be reduced.

Third Embodiment

In the first and second embodiments, on the basis of the sheet size information (width direction) acquired from the driver 102, the airflow ratio between the inside fans (first fans) and the outside fans (second fans) was controlled. In this embodiment, on the basis of information (detection temperature) of contact thermistors 7 (**7*b*2, 7*b*3**), the airflow rates of the respective fans are changed (preferably, a total airflow rate is changed while keeping an airflow ratio). That is, at a second temperature higher than a first temperature in terms of a detection temperature, each of the airflow rates of the first and second fans at the first temperature is made high while keeping the airflow ratio at the first temperature.

Figure 9:
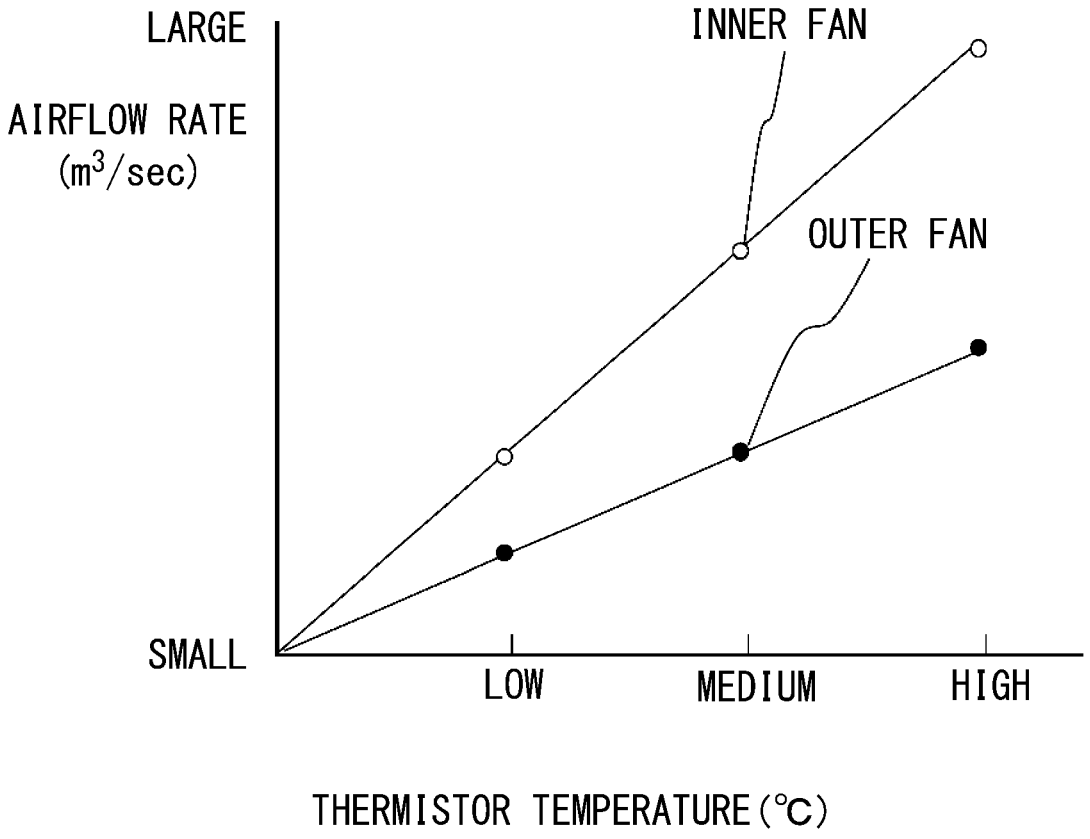
FIG. 9 is a view (graph) for illustrating a cooling mode of fans on the basis of a thermistor temperature.

Specifically, as shown in FIG. 9, on the basis of the detection temperatures of the contact thermistors 7 (**7*b*2, 7*b*3**) provided in the non-sheet-passing region, a necessary that airflow rate is discriminated, and the airflow rate of each of the fans is controlled while keeping the airflow ratio set on the basis of the sheet size information described in the first and second embodiments.

FIG. 9 is premised on the case where the controller 100 discriminated that the sheet width W described in the first and second embodiments in narrower than W1, and the controller 100 sets, in the case where the detection temperature is high, the airflow ratio so that the airflow ratio of the inside fans which are the first fans is 70% and the outside fans which are the second fans is 30%. In FIG. 9, a white circle of a solid line represents the airflow rate of the inside fans (fan 82, fan 83), and a black circle of a solid line represents the airflow rate of the outside fans (fan 81, fan 84).

In FIG. 9, on the basis of the detection temperatures of the thermistors, three cooling modes are provided. Then, from a magnitude relationship between a temperature T detected by the contact thermistor 7 provided in the non-sheet-passing region and temperatures T1 and T2 determined in advance, the cooling mode is switched. The temperature T is, for example, a temperature which is a higher one of the detection temperatures the contact thermistors 7*b*2 and 7*b*3. The cooling mode is classified into three modes consisting of cooling mode: low in the case where the detected temperature is lower than the predetermined temperature T1, cooling mode: medium in the case where the detected temperature T is T1 or more and lower than T2, and cooling mode: high in the case where the detected temperature T is T2 or more, and the airflow rates are made different in the respective modes.

In this embodiment, T1=180° and T2=200° were set. The predetermined temperatures T1 and T2 may also not necessarily be the above-described temperature. Further, in each of the cooling modes, the airflow ratio of the inside fans (fan 82, fan 83) and the airflow of the outside fans (fan 81, fan 84) may desirably be the same. That is, the airflow rates of the respective fans proportionally become large with an increasing temperature T. The respective airflow rates of the inside fans (fan 82, fan 83) and the outside fans (fan 81, fan 84) may only be required to fall within ±5 & of target airflow rates.

The case where the sheet width W in the above-described embodiments is narrower than W1 is a premise, and the airflow rates of the fans 81 to 84 depending on the thermistor temperatures of "low", "medium" and "high" are shown in Table 3 by taking the total airflow rate (ratio) of the fans on one end side with respect to the longitudinal direction as 100%.

TABLE 3

| TT*[1] | Fan 81 | Fan 82 | Fan 83 | Fan 84 |
|---|---|---|---|---|
| T < T1 | 18% | 42% | 42% | 18% |
| T1 ≤ T < T2 | 24% | 56% | 56% | 24% |
| T ≥ T2 | 30% | 70% | 70% | 30% |

*[1]"TT" is the thermistor temperature.

In the case where the cooling operation is executed in the case where the images are continuously fixed on a plurality of sheets of the recording materials with a sheet size smaller than the first size W1, even in a state in which the cooling operation is needed, when the temperature in the end portion region is low, the airflow rates (rotational speeds) of the respective fans are decreased is employed. That is, in the case where the cooling is executed in the case where the images are continuously fixed on the plurality of sheets of the recording materials with the sheet size smaller than the first size W1, the inside fans are rotated at a speed such that a maximum rotational speed thereof provides the airflow rate of 70%. Similarly, the outside fans are rotated at a speed such that a maximum rotational speed thereof provides the airflow rate of 30%.

Incidentally, in the description of this embodiment 3, the description of the table 3 was made by taking the sheet size smaller than the first size W1 as an example. In the case where discrimination that cooling in the end portion regions (non-sheet-passing portions) is needed is made and the cooling operation is executed in the case where the images are continuously fixed on a plurality of sheets of the recording materials with a sheet size larger than the first size W1 described in the embodiment 1, the inside fans may only be required to be rotated at a speed such that a maximum rotational speed thereof provides the airflow rate of 50%. Similarly, the outside fans are rotated at a speed such that a maximum rotational speed thereof provides the airflow rate of 50%. Further, even in a state in which the cooling operation is needed, when the temperature in the end portion region is low, the airflow rates (rotational speeds) of the respective fans are decreased.

Incidentally, there is no need that the number of the cooling modes in three, and may also be two or four or more. In such this embodiment, with a simple constitution, the non-sheet-passing portion temperature rise can be reduced without operating the fans more than necessary and without excessively lowering the temperature of the fixing film 3 more than necessary.

Modified Embodiments

In the above, although preferred embodiments of the present invention were described, the present invention is not limited thereto but can also be variously modified and changed within a range of the scope thereof.

Modified Embodiment 1

In the above-described third embodiment, a sensor for detecting the temperature of the first rotatable member in the first region on one end side with respect to the longitudinal direction of the first rotatable member was provided, and depending on output of the sensor, the airflow rates of the first fan for cooling the first region and the second fan for cooling the second region on one end side with respect to the longitudinal direction than the first region was, were controlled. The present invention is not limited thereto, but may also employ the following constitution. That is, the sensor for detecting the temperature of the first rotatable member in the first region on one end side with respect to the longitudinal direction of the first rotatable member is provided, and depending on the output of the sensor, it is also possible to control the airflow ratios of the first fan for cooling the first region and the second fan for cooling the second region on one end side with respect to the longitudinal direction than the first region is.

Modified Embodiment 2

In the above-described embodiments, the controller of the image forming apparatus controlled the airflow rates of the respective fans. Such a controller relating to the airflow rate control is not limited to the controller included in the image forming apparatus, but may also be included in the fixing device.

Modified Embodiment 3

In the above-described embodiments, as the heat generating element (member), the heater for heating the fixing film (endless belt) in contact with the inner surface of the fixing film was described, but the present invention is not limited thereto. A constitution in which the fixing film includes a heat generating layer and heat is generated by an exciting (magnetizing) coil or energization (constitution in which the fixing film as the first rotatable member also functions as the heat generating element) may also be employed.

Modified Embodiment 4

In the above-described embodiments, the controller carried out control so that in the case of the recording material with the first size, the airflow rate of the first fans (inside fans) is made equal to the airflow rate of the second fans (outside fans). Further, in the case of the recording material with the second size larger than the first size with respect to the longitudinal direction (width direction), control was carried out so that the airflow rate of the first fans was made larger than the airflow rate of the second fans.

The present invention is not limited thereto, it is also possible to carry out control so that in the case of the recording material with the first size, the airflow rate of the first fans is made smaller than the airflow rate of the second fans and so that in the case of the recording material with the second size, the airflow rate of the first fans is made larger than the airflow rate of the second fans.

Modified Embodiment 5

In the above-described embodiments, as the pressing member opposing the endless belt as the first rotatable member the pressing roller was used, but in place of the pressing roller, the pressing member may also be constituted by an endless belt.

Further, in the above-described embodiments, the case where the rotatable pressing member as the rotatable member and as the pressing member pressed the rotatable fixing member was described. However, the present invention is not limited thereto, but is similarly applicable to also the case where the rotatable member as an opposing member, not the pressing member is pressed by the rotatable fixing member.

Modified Embodiment 6

Further, in the above-described embodiments, as the recording material, the recording paper was described, but the recording material in the present invention is not limited to the paper. In general, the recording material is a sheet-shaped member on which the toner image is formed by the image forming apparatus and includes, for example, regular or irregular members of plain paper, thick paper, thin paper, envelope, post-card, seal, resin sheet, OHP sheet, glossy paper and the like. Incidentally, in the above-described embodiments, for convenience, dealing of the recording material (sheet) P was described using terms, such as the sheet passing, and sheet feeding, but by this, the recording material in the present invention is not limited to the paper.

Modified Embodiment 7

In the above-described embodiments, the fixing device for fixing the unfixed toner image on the sheet was described as an example, but the present invention is not limited thereto, and is also similarly applicable to an apparatus for heating and pressing a toner image, temporarily fixed on the sheet, in order to improve glossiness of the image (also in this case, the apparatus is called the fixing device).

INDUSTRIAL APPLICABILITY

According to the present invention, there is provided an image heating apparatus capable of suppressing temperature rise of the rotatable member in the non-sheet-passing portion for recording materials with various width sizes.

The invention claimed is:

1. An image heating apparatus comprising:

a first rotatable member;

a second rotatable member configured to form, with the first rotatable member, a nip for heating a toner image on a recording material while feeding the recording material;

a first cooling fan configured to cool an end portion region of said first rotatable member on one end side, said first cooling fan being provided at a position opposing a first region which is a part of the end portion region;

a second cooling fan configured to cool the end portion region of said first rotatable member on said one end side, said second cooling fan being provided at a position opposing a second region which is a part of the end portion region, said second region being adjacent to said first region with respect to the longitudinal direction and being closer to an end of said first rotatable member on said one end side than said first region;

an air blowing port configured to send air from said first and second cooling fans toward said first rotatable member;

a shutter member configured to change an opening width of said air blowing port;

a shutter controller configured to control a position of said shutter member depending on a width size of the recording material heated in the nip; and a fan controller configured to independently control a flow amount of said first cooling fan and a flow amount of said second cooling fan depending on the width size of the recording material heated in the nip, in a state in which said shutter member is positioned by said shutter controller at a position depending on the width size of the recording material heated in the nip, wherein said fan controller controls the flow amount of said first and second cooling fans so that an airflow ratio of the flow amount of said first cooling fan to that of said second cooling fan is set to a first airflow ratio when the opening width of said air blowing port is a first width, and the airflow ratio of the flow amount of said first cooling fan to that of said second cooling fan is set to a second airflow ratio larger than the first airflow ratio when the opening width of said air blowing port is a second width wider than the second width.

2. The image heating apparatus according to claim 1, wherein, in a case that the end portion region is cooled during execution of a first heating process, said fan controller operates said second cooling fan while operating said first cooling fan, the first heating process includes continuously heating in the nip a plurality of sheets of recording materials with a first width size, the first width size being a size such that a recording material end portion with respect to the longitudinal direction passes through the end portion region during the first heating process, and wherein, in a case that the end portion region is cooled during execution of a second heating process, said fan controller operates said second cooling fan while causing said first cooling fan to heat rest, the second heating process includes continuously heating in the nip a plurality of sheets of recording materials with a second width size, the second width size being larger than the first width size and being a size such that a recording material end portion with respect to the longitudinal direction passes through the end portion region during the second heating process.

3. The image heating apparatus according to claim 2, further comprising, a detecting portion configured to detect a temperature of the end portion region, wherein said fan controller operates said first cooling fan and said second cooling fan in a case that a temperature of said detecting portion reaches a predetermined temperature during the execution of the first heating process, and wherein said fan controller operates said second cooling fan in a case that a temperature of said detecting portion reaches a predetermined temperature during the execution of the second heating process.

4. The image heating apparatus according to claim 1, wherein, in a case that the end portion region is cooled during execution of a first heating process said fan controller operates said second cooling fan while operating said first cooling fan so that a maximum rotational speed of said first cooling fan during the execution of the first heating process is a first rotational speed, the first heating process includes continuously heating in the nip a plurality of sheets of recording materials with a first width size, the first width size being a size such that a recording material end portion with respect to the longitudinal direction passes through the end portion region during the first heating process, and wherein, in a case that the end portion region is cooled during execution of a second heating process, said fan controller operates said second cooling fan while operating said first cooling fan so that a maximum rotational speed of said first cooling fan during the execution of the second heating process is a second rotational speed slower than the first rotational speed, the second heating process includes continuously heating in the nip a plurality of sheets of recording materials with a second width size, the second width size being larger than the first width size and being a size such that a recording material end portion with respect to the longitudinal direction passes through the end portion region during the second heating process.

5. The image heating apparatus according to claim 4, further comprising, a detecting portion configured to detect a temperature of the end portion region, wherein said fan controller operates said first cooling fan so that the maximum rotational speed is the first rotational speed in a case that a temperature of said detecting portion reaches a predetermined temperature during the execution of the first heating process, and wherein said fan controller operates said first cooling fan so that the maximum rotational speed is the second rotational speed in a case that a temperature of said detecting portion reaches the predetermined temperature during the execution of the second heating process.

6. The image heating apparatus according to claim 4, wherein, in a case that the end portion region is cooled during execution of the first heating process, said fan controller operates said second cooling fan so that the maximum rotational speed is a third rotational speed while operating said first cooling fan so that the maximum rotational speed during execution of the first heating process is the first rotational speed, and wherein, in a case that the end portion region is cooled during execution of the second heating process, said fan operates said second cooling fan so that the maximum rotational speed is a fourth rotational speed faster than the third rotational speed while operating said first cooling fan so that the maximum rotational speed during execution of the second heating process is the second rotational speed.

7. An image heating apparatus according to claim 4, wherein the first width size is a size in which an end portion of the recording material with respect to the longitudinal direction passes through the first region when the recording material is heated in the nip.

8. The image heating apparatus according to claim 1, wherein said fan controller controls a rotational speed of said first cooling fan by controlling an input voltage to a motor for said first cooling fan, and controls a rotational speed of said second cooling fan by controlling an input voltage to a motor for said second cooling fan.

9. The image heating apparatus according to claim 1, further comprising:

a third cooling fan configured to cool another end portion region of said first rotatable member on the other end side, said third cooling fan being provided at a position opposing a third region of said first rotatable member on the other end side which is part of the other end portion region;

a fourth cooling fan configured to cool the other end portion region of said first rotatable member on the other end side, said fourth cooling fan being provided at a position opposing a fourth region which part of the other end portion region, said fourth region being adjacent to said third region with respect to the longitudinal direction and being closer to an end of said first rotatable member on the other end side than said third region, wherein said air blowing port is configured to send air from said third and fourth cooling fans toward said first rotatable member; and wherein said fan controller individually controls the operation of said third cooling fan and the operation of said fourth cooling fan depending on the position of said shutter member.

10. The image heating apparatus according to claim 1, further comprising, a heater contacting an inside of said first rotatable member and configured to heat said first rotatable member, wherein said first rotatable member is a rotatable film contactable to an unfixed toner image carrying surface of the recording material in the nip, said first rotatable member pressing said heater through said film.

11. An image heating apparatus according to claim 1, wherein said shutter controller controls the position of said shutter member so that an overlap amount of said first fooling fan and said shutter member is set to a first overlap amount when the opening width of said air blowing port is the first width, and the overlap amount of said first fooling fan and said shutter member is set to a second overlap amount smaller than the first overlap amount when the opening width of said air blowing port is the second width.

* * * * *